US008807714B2

(12) United States Patent
Moriai et al.

(10) Patent No.: US 8,807,714 B2
(45) Date of Patent: Aug. 19, 2014

(54) INK-JET RECORDING APPARATUS

(75) Inventors: Takuya Moriai, Hitachi (JP); Nobuhiro Harada, Hitachi (JP); Masahiko Sakuraba, Hitachi (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 205 days.

(21) Appl. No.: 13/202,551

(22) PCT Filed: Jun. 24, 2009

(86) PCT No.: PCT/JP2009/061512

§ 371 (c)(1),
(2), (4) Date: Nov. 4, 2011

(87) PCT Pub. No.: WO2010/150370

PCT Pub. Date: Dec. 29, 2010

(65) Prior Publication Data

US 2012/0086745 A1 Apr. 12, 2012

(51) Int. Cl.
*B41J 2/02* (2006.01)

(52) U.S. Cl.
USPC ..... 347/73; 347/79; 347/4

(58) Field of Classification Search
USPC ..... 347/4, 16, 54, 5, 73, 79
IPC ..... B41J 2/02
See application file for complete search history.

(56) References Cited

U.S. PATENT DOCUMENTS

| | | | | |
|---|---|---|---|---|
| 4,769,650 | A * | 9/1988 | Peng et al. | 347/4 |
| 6,046,822 | A | 4/2000 | Wen et al. | |

FOREIGN PATENT DOCUMENTS

| | | | |
|---|---|---|---|
| EP | 0 197 300 | A1 | 10/1986 |
| EP | 0 931 663 | A2 | 7/1999 |
| JP | 62-035853 | | 2/1987 |
| JP | 06-143585 | | 5/1994 |
| JP | 07-081065 | | 3/1995 |
| JP | 08-197738 | | 8/1996 |
| JP | 10-217444 | | 8/1998 |
| JP | 3123555 | | 1/2001 |
| JP | 2007-261158 | | 10/2007 |

OTHER PUBLICATIONS

Extended European Search Report issued in European Patent Application No. 09846503.2 dated Jan. 15, 2013.

* cited by examiner

*Primary Examiner* — Lam S Nguyen
(74) *Attorney, Agent, or Firm* — McDermott Will & Emery LLP

(57) ABSTRACT

An ink-jet recording apparatus has a print head 13 incorporating: a nozzle 20, which vibrates ink at a constant cycle, jets out the ink, and atomizes the ink; an electrification electrode 26, which electrify an ink particle 19; and deflection electrodes 27*b*, which deflect the electrified ink particle in a main scanning direction. The print head 13 carries out printing by causing the ink particle to fly to a printing workpiece W conveyed by a conveyer 15. Flying time of the ink particle in a printing distance La between the printing workpiece W and the print head 13 is calculated, timing of an electrification signal supplied to the electrification electrode 26 is controlled in accordance with the flying time, and a printing position to the printing workpiece W is set. Thus, printing can be carried out at a predetermined position to the printing workpiece W, and printing quality can be enhanced.

5 Claims, 9 Drawing Sheets

PRESENT INVENTIO

COMPARATIVE EXAMPLE

INK-JET RECORDING APPARATUS

RELATED APPLICATIONS

This application is the U.S. National Phase under 35 U.S.C. §371 of International Application No. PCT/JP2009/061512, filed on Jun. 24, 2009, the disclosure of which is incorporated by reference herein.

TECHNICAL FIELD

The present invention relates to an ink-jet recording apparatus that carries out printing by causing ink particles to land on a printing workpiece.

BACKGROUND ART

As an ink-jet recording apparatus for printing, i.e., marking characters and figures on a manufactured product serving as a printing workpiece, which is conveyed by a conveying apparatus such as a conveyer, an apparatus of a non-contact type which causes ink to fly from a nozzle toward the printing workpiece without bringing the nozzle of a print head into contact with the printing workpiece is used. For example, when characters or the like are to be printed on a lateral surface or an upper surface of a packaging material such as a cardboard box in which a commercial product is packaged, the printing on the surface of the packaging material is carried out by an ink-jet recording apparatus while conveying the material by a conveyer; and, also in the case in which printing is to be carried out on a container housing food or drink, printing is carried out on the outer surface of the container while conveying the container by a conveyer.

A print head is stopped in the case in which printing is carried out while moving a printing workpiece in the above-described manner; on the other hand, a print head is moved along a printing workpiece in the case in which the printing workpiece is subjected to printing in the state in which the conveyer is stopped upon printing. For example, in the case in which a plurality of locations of an assembled printed circuit board is to be subjected to printing, printing is carried out while a print head is moved in two-dimensional directions along the printed circuit board in the state in which the conveyer is stopped.

In the ink-jet recording apparatus which carries out printing on the printing workpiece conveyed by the conveyer, a write-starting position with respect to the printing workpiece is set in the manner described in Patent Document 1. Ink particles are caused to fly toward the printing workpiece when the printing workpiece is conveyed by a write-starting distance after it is detected that the printing workpiece has been conveyed to a predetermined position. The ink particles are caused to land on the printing workpiece after being deflected and caused to fly the printing distance between the print head and the printing workpiece; therefore, if the printing distance is changed, the landing positions are changed in the deflection direction of the ink particles. Therefore, in ink-jet recording apparatuses described in Patent Document 2 and Patent Document 3, the electrification voltage supplied to an electrification electrode is configured to be corrected in accordance with the printing distance.

Patent Document 4 describes an ink-jet recording apparatus which is configured to adjust the flying speed of the ink particles in accordance with the printing distance. Patent Document 5 describes an ink-jet recording apparatus which is configured to change the discharge pressure of the ink droplets from the nozzle in accordance with the change in the distance when the distance between the distal end of the nozzle and print paper is changed.

RELATED ART DOCUMENT

Patent Document

Patent Document 1: Japanese Patent Application Laid-Open Publication No. 6-143585

Patent Document 2: Japanese Patent Application Laid-Open Publication No. 8-197738

Patent Document 3: Japanese Patent Application Laid-Open Publication No. 7-81065

Patent Document 4: Japanese Patent Application Laid-Open Publication No. 10-217444

Patent Document 5: Japanese Patent Application Laid-Open Publication No. 2007-261158

DISCLOSURE OF THE INVENTION

Problems to be Solved by the Invention

As described in Patent Documents 1 to 3, in an ink-jet recording apparatus having: a nozzle which vibrates ink at a constant cycle to jet out and atomize the ink; electrification electrodes which electrify particles of the ink; and deflection electrodes which deflect the electrified ink particles in a main scanning direction; the output timing of electrification signals to the electrification electrode is set based on the signals from an encoder which outputs pulse signals proportional to the speed of the conveyer conveying the printing workpiece.

The ink-jet recording apparatus outputs the electrification signals to the electrification electrode every time the pulses are input from the encoder so as to carry out printing in the main scanning direction. However, such a control method causes a problem that the higher the conveying speed of the printing workpiece, the more notable the displacement of the printing position becomes. The reason of displacing the printing position is that the flying time is taken from the electrification of the ink particles until the ink particles reach the printing workpiece since the electrification signals are output to the electrification electrode when the printing workpiece is conveyed by the conveyer and positioned at the printing position in front of the printing nozzle. The printing workpiece is conveyed by the conveyer even during the flying time, and the printing position is displaced as a result.

A conceivable measure to solve this problem is to obtain the flying time of the ink particles and advance the electrification signals, which are supplied to the electrification electrode, by the flying time. When this control method is used, printing can be carried out at ideal positions as long as the ink particle flying time obtained in advance matches the actual ink particle flying time. However, in the case in which printing is to be carried out on the printing workpiece conveyed by the conveyer, the printing distance between the printing workpiece and the print head is different depending on the type of the printing workpiece. Therefore, when the printing distance is changed, there are problems that the flying time of the ink particles is largely changed, the printing positions are displaced, and printing quality cannot be enhanced.

It is a preferred aim of the present invention to provide an ink-jet recording apparatus capable of enhancing the printing quality.

It is another preferred aim of the present invention to provide an ink-jet recording apparatus capable of carrying out high-quality printing at predetermined positions of a printing workpiece even when the printing distance between a print head and the printing workpiece is changed.

Means for Solving the Problems

An ink-jet recording apparatus of the present invention has a print head incorporating a nozzle vibrating ink at a constant cycle, jetting out the ink, and atomizing the ink, an electrification electrode electrifying ink particles, and deflection electrodes deflecting the ink particles being electrified in a main scanning direction, the ink-jet recording apparatus carrying out printing by causing the ink particle to fly to a printing workpiece relatively moving with respect to the print head in a sub scanning direction substantially orthogonal to the main scanning direction, the ink-jet recording apparatus including: flying time calculating means for calculating flying time of the ink particle in a printing distance between the print head and the printing workpiece at the point when the printing workpiece is relatively moved to a position opposed to the print head; and electrification timing control means for controlling timing of an electrification signal supplied to the electrification electrode in accordance with the flying time and setting a printing position with respect to the printing workpiece.

The ink-jet recording apparatus of the present invention includes: an input operation part for inputting information of the printing distance; and storage means for storing the input information of the printing distance, in which the flying time calculating means calculates the flying time based on the information of the printing distance stored in the storage means. Also, the ink-jet recording apparatus of the present invention includes a printing distance measuring sensor detecting the printing distance, in which the flying time calculating means calculates the flying time based on the information of the printing distance detected by the printing distance measuring sensor.

The ink-jet recording apparatus of the present invention includes: a print sensor detecting that the printing workpiece is moved to a predetermined position in an upstream side of the relative movement direction with respect to the print head, in which the electrification timing setting means sets the printing position by subtracting the ink flying time from print write-starting time, which is from detection of the printing workpiece by the print sensor until printing. The ink-jet recording apparatus of the present invention includes an encoder outputting a pulse waveform proportional to a speed of the relative movement of the printing workpiece with respect to the print head, in which electrification timing is controlled based on the number of pulses corresponding to the flying time. The ink-jet recording apparatus of the present invention controls electrification timing by adding internal flying time of the ink particle in a print head internal distance between the electrification electrode and a distal end surface of the print head to the flying time.

Effects of the Invention

In the ink-jet recording apparatus of the present invention, the flying time taken until the ink particle reaches the printing workpiece from the print head is calculated based on the printing distance between the print head and the printing workpiece, and the timing of the electrification signal supplied to the electrification electrode is controlled in accordance with the flying time; therefore, printing can be carried out at the predetermined position of the printing workpiece. Thus, printing quality can be improved.

In the case in which printing is to be carried out with respect to printing workpieces conveyed by a conveying apparatus, if the printing distances with respect to all of the printing workpieces are constant, the printing distance is stored in a memory in advance, and the electrification timing is calculated based on the stored printing distance. This case is suitable for the case in which printing is to be carried out with respect to a plurality of printing workpieces for which the same printing distance is set. On the other hand, in the case in which a plurality of types of printing workpieces having mutually different sizes are mixed and printing processes are to be carried out with respect to the printing workpieces conveyed by the conveying apparatus, the printing distance is detected by the printing distance measuring sensor, and the electrification timing is controlled based on the detected printing distance. In this case, even with respect to the plurality of types of printing workpieces having mutually different sizes, printing can be carried out highly precisely at the set predetermined position.

The relative positions between the print head and the printing workpiece are detected by the print sensor. The print write-starting time which is from the detection by the print sensor that the printing workpiece is moved to a predetermined upstream-side position with respect to the print head until printing is set. The electrification timing at which the electrification signal is supplied to the electrification electrode is calculated by subtracting the flying time from the print write-starting time. By controlling the electrification timing with adding the flying time inside the print head to the flying time of the ink, printing quality can be further enhanced.

The ink-jet recording apparatus of the present invention is used to both of the case in which printing is carried out by causing the ink particles to fly from the print head fixed with respect to the printing workpiece conveyed by the conveying apparatus and the case in which printing is carried out by moving the print head with respect to the printing workpiece.

BRIEF DESCRIPTIONS OF THE DRAWINGS

BEST MODE FOR CARRYING OUT THE INVENTION

Figure 1:
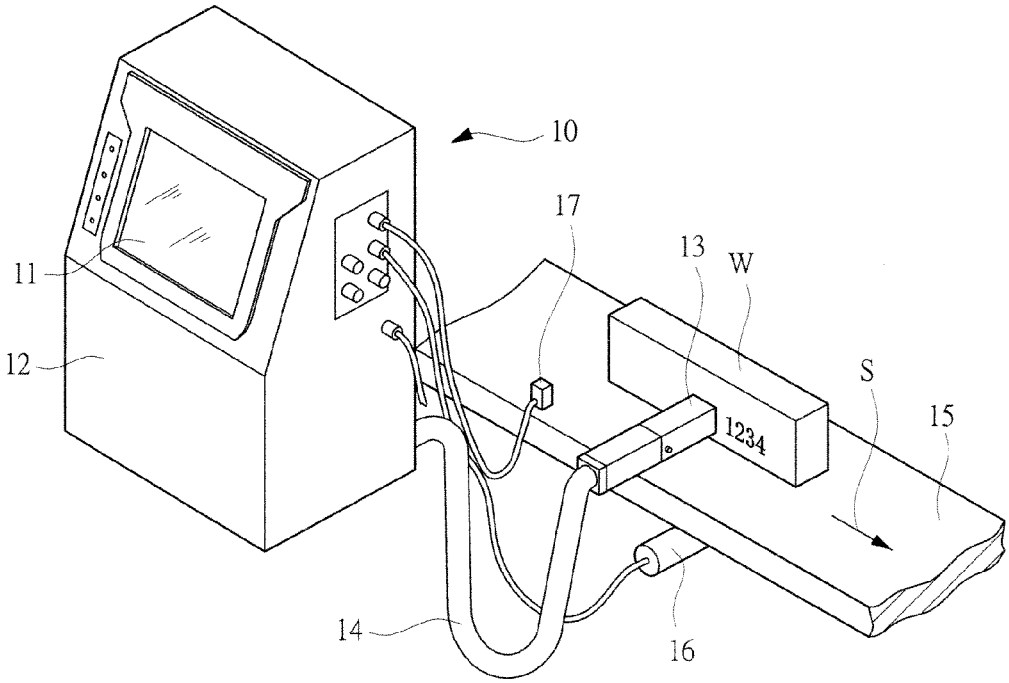
FIG. 1 is a perspective view illustrating appearance of an ink-jet recording apparatus which is an embodiment of the present invention.

Hereinafter, an embodiment of the present invention will be described in detail based on the drawings. As illustrated in FIG. 1, an ink-jet recording apparatus 10 has an apparatus main body 12 provided with an operation display unit 11 on the front thereof, and a print head 13 is connected to the apparatus main body 12 by a conduit 14. For example, as illustrated in FIG. 1, the ink-jet recording apparatus 10 is installed at a production line of a factory which produces food, drink, etc., employs packages of food, etc. as printing targets, i.e., printing workpieces W, and used for subjecting them to marking. The apparatus main body 12 is disposed on a supporting base, which is not illustrated, so that the apparatus is at a position to be operatable by a user. The print head 13 is installed on a supporting base, which is not illustrated, so as to be in the vicinity of the printing workpiece W conveyed by a belt conveyer 15, and the printing workpiece W moved by the belt conveyer 15 in the direction illustrated by an arrow S is subjected to printing operations by the ink-jet recording apparatus 10.

In order to carry out printing on the printing workpiece W at a same width regardless of the moving speed of the printing workpiece W caused by the belt conveyer 15, the belt conveyer 15 serving as the production line is provided with an encoder 16, which outputs signals in accordance with the moving speed, as moving-direction position detecting means of the printing workpiece W. A print sensor 17, which detects that the printing workpiece W conveyed by the belt conveyer 15 has reached a predetermined position in the upstream side of the moving direction with respect to the print head 13 and outputs a signal for giving the ink-jet recording apparatus 10 an instruction to start printing, is disposed to be in the vicinity of the belt conveyer 15. The encoder 16 and the printing sensor 17 are connected to a control unit in the apparatus main body 12 via signal lines.

Figure 2:
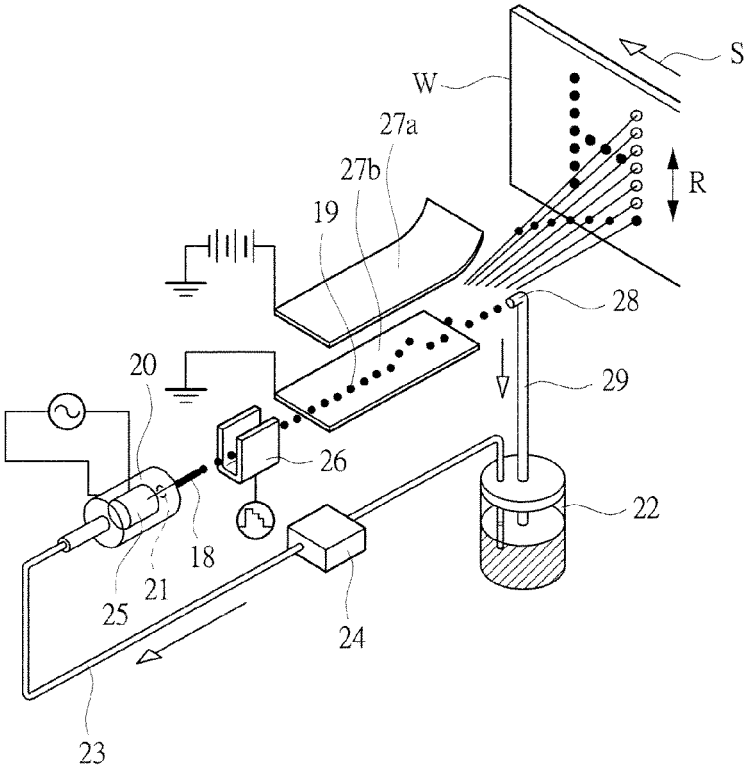
FIG. 2 is an outline drawing illustrating the internal structure of a print head illustrated in FIG. 1.

As illustrated in FIG. 2, the print head 13 has a nozzle 20, which discharges an ink column 18; an ink supply channel 23, which supplies ink in an ink container 22 disposed in the apparatus main body 12, is connected to the nozzle 20; and the ink supply channel 23 is provided with a supply pump 24. The ink in the ink container 22 is sucked and pressurized by the supply pump 24, changed into an ink column 18, and jetted out from an exhaust opening 21 of the nozzle 20. The nozzle 20 is provided with an electrostrictive element 25, the ink is vibrated at a constant cycle by the electrostrictive element 25, and the ink column 18 jetted out from the exhaust opening 21 of the nozzle 20 is atomized. The number of generated ink particles 19 is determined by the frequency of the excitation voltage applied to the electrostrictive element 25 and is equal to the number of the frequency.

An electrification electrode 26 is disposed in front of the nozzle 20 so that the ink particles 19 are electrically charged by applying a voltage having a magnitude corresponding to printing information to the electrification electrode 26. In front of the electrification electrode 26, a plus deflection electrode 27*a* and a minus deflection electrode 27*b* are disposed with a gap interposed therebetween. The ink particles 19 electrified by the electrification electrode 26 receive and are deflected by the force proportional to an electrification amount while flying in the electric field formed between both of the deflection electrodes 27*a* and 27*b*, fly toward the printing workpiece W, and land on the printing workpiece W. In this process, the landing positions of the ink particles 19 are changed in a deflection direction, in other words, a main scanning direction illustrated by an arrow R in accordance with the electrification amount, and, furthermore, the belt conveyer 15 moves the printing workpiece W in the moving direction, in other words, a sub scanning direction S approximately orthogonal to the main scanning direction R; as a result, the ink particles 19 are landed also in the direction orthogonal to the deflection direction. Thus, a character or a figure is marked in the shape of a dot matrix on the printing workpiece W by the plurality of landed particles.

In order to collect the ink particles 19 which are not used in printing, a gutter 28 is disposed in the print head 13 so as to be opposed to the exhaust opening of the nozzle 20, and the ink particles 19 which linearly fly between the deflection electrodes 27*a* and 27*b* without being deflected are captured by the gutter 28. The captured ink particles 19 are configured to be collected in the ink container 22 by a collection channel 29.

The ink-jet recording apparatus 10 illustrated in FIG. 1 carries out printing with respect to the printing workpiece W while conveying the printing workpiece by the belt conveyer 15, and the printing workpiece W is moved in the sub scanning direction S with respect to the print head 13 by the belt conveyer 15. On the other hand, in the case in which a printing operation is carried out with respect to the printing workpiece W in the state in which the belt conveyer 15 is stopped, the printing workpiece W is moved in the sub scanning direction S with respect to the print head 13 by moving the print head 13. In this manner, the printing workpiece W is subjected to marking when the print head 13 is moved in the sub scanning direction S relatively with respect to the printing workpiece W.

Figure 3:
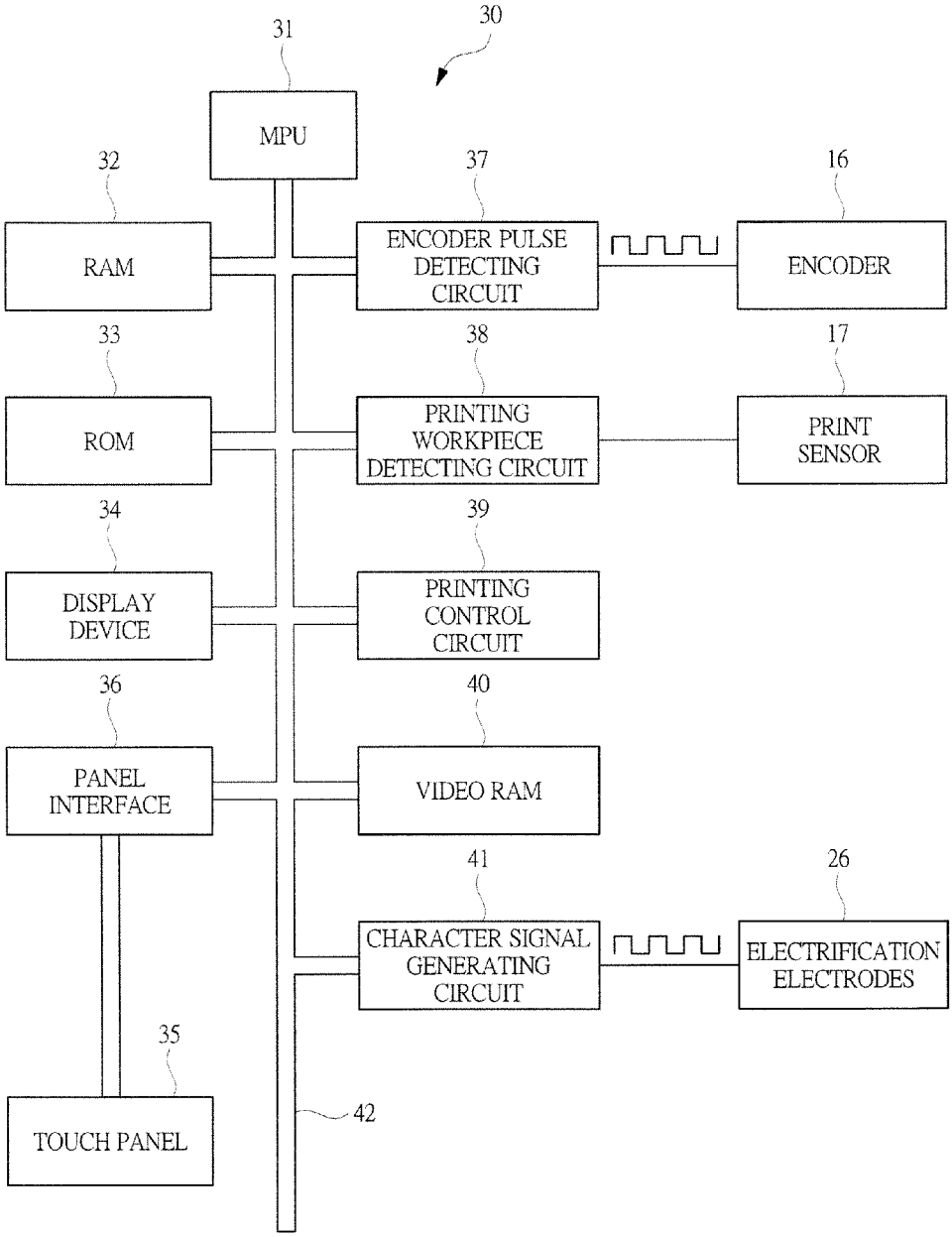
FIG. 3 is a block diagram illustrating a control circuit of the ink-jet recording apparatus.

FIG. 3 is a block diagram illustrating a control unit 30 of the ink-jet recording apparatus 10. The control unit 30 has: an MPU (Micro Processing Unit) 31, which computes control signals; a ROM (Read Only Memory) 32, which stores control programs, arithmetic expressions, etc. in advance; and a RAM (Random Access Memory) 33, which temporarily stores data. The operation display unit 11 illustrated in FIG. 1 has a display unit, which displays the working state, printing contents, etc. of the ink-jet recording apparatus 10, and a touch panel, from which printing information, etc. is input by keys. A display unit 34 is connected to the MPU 31, and a touch panel 35 is connected to the MPU 31 via a panel interface 36. The encoder 16 illustrated in FIG. 1 is connected to an encoder pulse detecting circuit 37, and the print sensor 17 is connected to a printing workpiece detecting circuit 38.

The control unit 30 has a printing control circuit 39, which controls the printing operations carried out by the ink-jet recording apparatus 10, and a video RAM 40, which stores video data for electrifying the ink particles 19. The video data is converted to electrification signals by a character signal generating circuit 41, and the electrification signals are transmitted to the electrification electrode 26. The MPU 31 is connected by a bus line 42 for transmitting data, etc. to the members illustrated in FIG. 3.

In the above-described ink-jet recording apparatus 10, printing information such as printing contents and print write-starting time is input when an operator operates the touch panel 35, and the input information is transmitted to the MPU 31 via the panel interface 36. The print write-starting time is the time from detection of the printing workpiece W by the print sensor 17 until start of printing by the print head 13 with respect to the printing workpiece W. The MPU 31 creates the video data for electrifying the ink particles 19 in accordance with the printing information by the program stored in the ROM 33 and stores the information in the video RAM 40 via the bus line 42.

When the print sensor 17 detects that the printing workpiece W conveyed by the belt conveyer 15 has moved to a predetermined position in the upstream side of the print head 13, a command for starting printing reaches the MPU 31 through the printing workpiece detecting circuit 38. Consequently, the MPU 31 transmits the video data, which is stored in the video RAM 40, to the character signal generating circuit 41 via the bus line 42. The character signal generating circuit 41 converts the transmitted video data to an electrification signal. When the print write-starting time elapses after the print sensor 17 detects the printing workpiece W, every time the encoder pulse detecting circuit 37 detects a pulse from the encoder 16, the printing control circuit 39 controls the timing for transmitting the electrification signal corresponding to a single main scanning direction to the electrification electrode 26 via the bus line 42.

In this manner, every time the pulse is input from the encoder 16 to the encoder pulse detecting circuit 37, the electrification signal corresponding to the single main scanning direction is transmitted to the electrification electrode 26. The ink jetted out from the nozzle 20 is atomized, subjected to electric charging, and electrified in the electrification electrode 26. The electrified ink particles 19 is deflected in accordance with the electrification amount when the ink particles fly and pass through the electric field formed by both the deflection electrodes 27*a* and 27*b*. As a result, the ink particles 19 fly toward and adhere to the printing workpiece W, thereby carrying out printing. The ink particles which are not electrified and are not used in the printing are captured by the gutter 28 and collected to the ink container 22.

Figure 4:
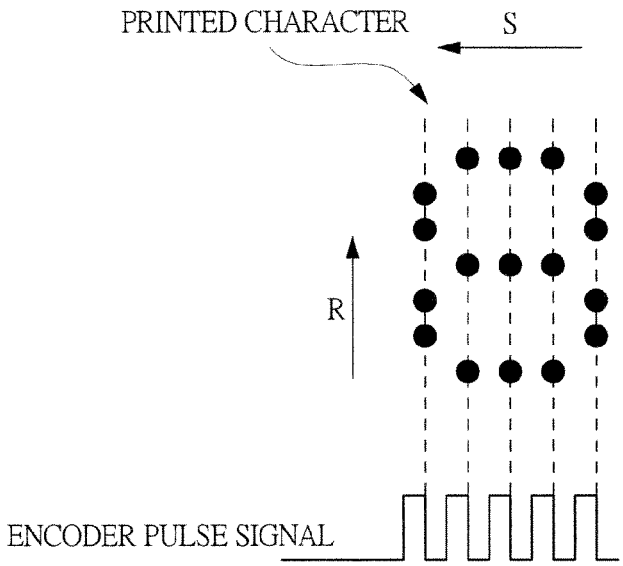
FIG. 4 is an outline drawing illustrating printing principles using an encoder.

FIG. 4 illustrates the state in which one character is printed on the printing workpiece W by deflecting the ink particles 19 in the main scanning direction R while using a fall in the pulse signal as a trigger every time the pulse signal is transmitted from the encoder 16 in the above-described manner and moving the printing workpiece W in the sub scanning direction S with respect to the print head 13.

Figure 5:
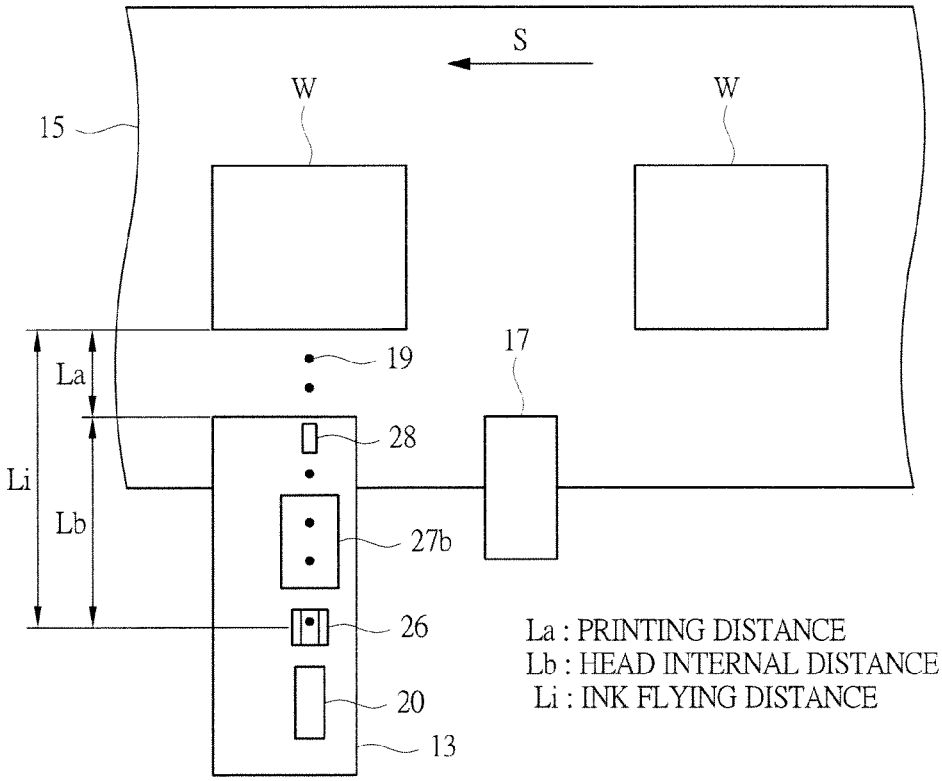
FIG. 5 is an outline drawing illustrating a print head in the state in which ink particles are flying toward a printing workpiece.

FIG. 5 illustrates the state in which the ink particles are flying toward the printing workpiece W. The print head 13 is disposed to be away from the printing workpiece W. When the printing workpiece is conveyed and moved by the belt conveyer 15 to the position opposed to the print head 13, the print head 13 is opposed to the printing workpiece W with a printing distance La therebetween. Therefore, the ink particles 19 jetted out from the front side of the print head 13 fly the printing distance La and then land on the printing workpiece W. Meanwhile, the ink particles 19 electrified by the electrification electrode 26 fly a head internal distance Lb from the electrification electrode 26 to the front side of the print head 13 and then are jetted out from the front side of the print head 13.

In this manner, the ink particles 19 electrified by the electrification electrode 26 fly an ink particle flying distance Li, which is a sum of the head internal distance Lb and the printing distance La, and land on the printing workpiece W. Therefore, a flying time Ti of the ink particles 19 can be expressed in the following manner when the flying speed of the ink particles 19 is V.

$$Ti=Li/V, \text{ wherein } Li=La+Lb \qquad \text{Expression (1)}$$

In the printing with respect to the printing workpiece W, various positions are set in the moving direction in accordance with the type of the printing workpiece W. A center part of the printing workpiece W in the conveyance direction is subjected to printing in some cases, and an end part thereof is subjected to printing in some cases. The printing position with respect to the printing workpiece W is set when an operator operates the touch panel 35. In this setting, the operator operates the touch panel 35 to input the time from detection of the printing workpiece W by the print sensor 17 until transmission of the electrification signal to the electrification electrode 26, in other words, the write-starting time To.

Figure 6:
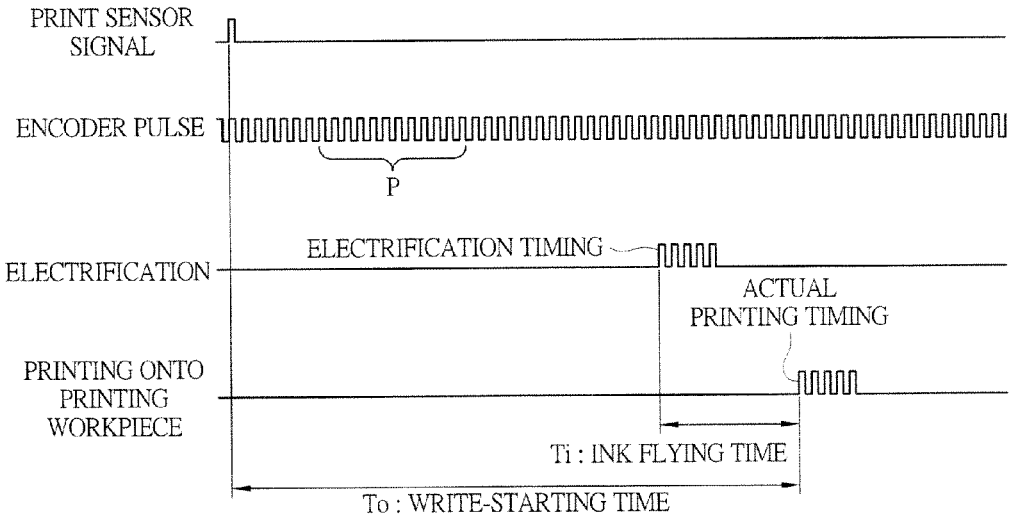
FIG. 6 is a time chart illustrating printing timing of the present invention.

FIG. 6 is a time chart illustrating printing timing of the present invention. As illustrated in FIG. 6, in the state in which the write-starting time To is set, if it is detected by the print sensor 17 that the printing workpiece W is at a predetermined position, control is carried out so that electrification timing is advanced to a point before the write-starting time To by the ink flying time Ti time obtained in accordance with the ink particle flying distance Li from the electrification electrode 26 to the printing workpiece W. As illustrated in FIG. 6, when the electrification timing is corrected so as to be advanced to the point before the write-starting time To, the timing at which the ink actually lands on the printing workpiece W, in other words, printing timing matches the write-starting time To. As a result, printing can be carried out on an ideal position with respect to the printing workpiece W, and thus printing quality can be enhanced.

Figure 7:
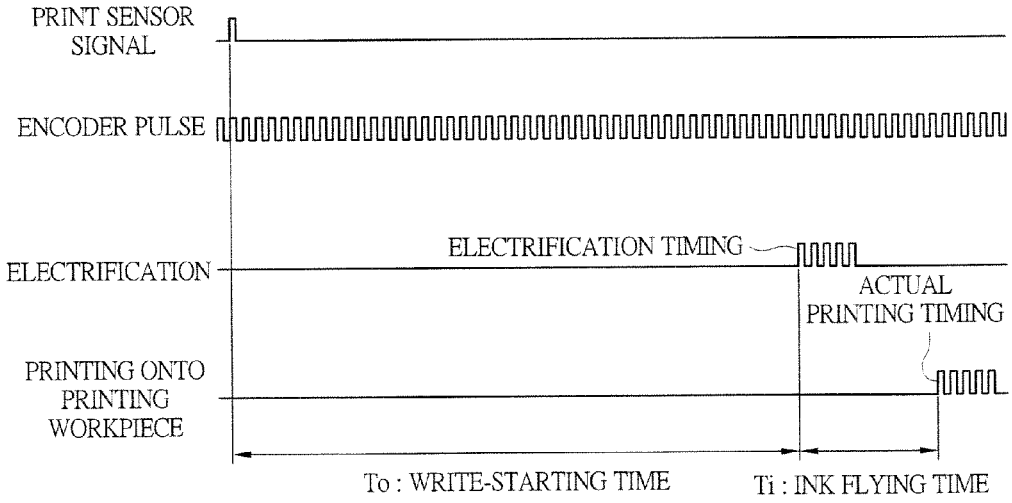
FIG. 7 is a time chart illustrating conventional printing timing as a comparative example.

FIG. 7 is a time chart illustrating conventional printing timing as a comparative example. As illustrated in FIG. 7, if the electrification signal is transmitted to the electrification electrode 26 at the point when the write-starting time To elapses after detection of the printing workpiece W by the print sensor 17, actual landing of the ink particles on the printing workpiece W is displaced by the ink flying time Ti.

Figure 8A:
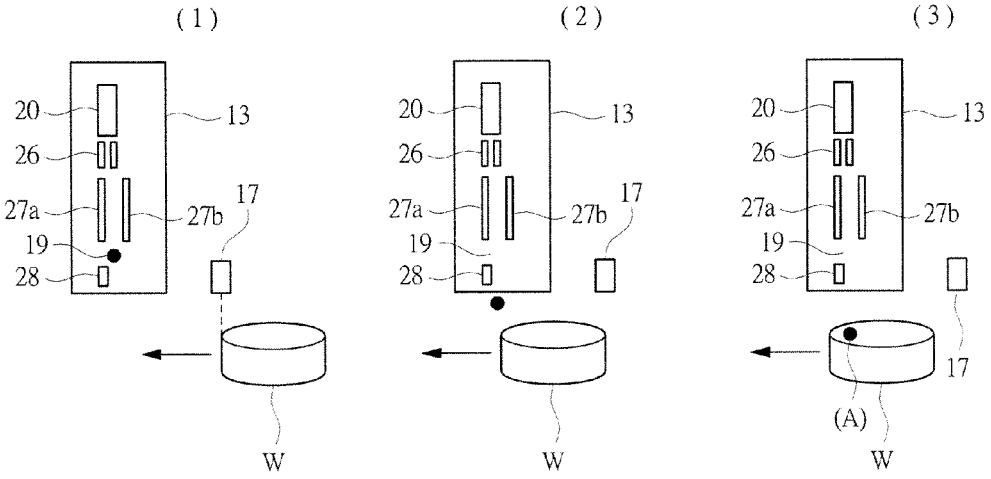
FIG. 8A illustrates outline drawings illustrating a landing state of an ink particle with respect to the printing workpiece in the ink-jet recording apparatus of the present invention.
Figure 8B:
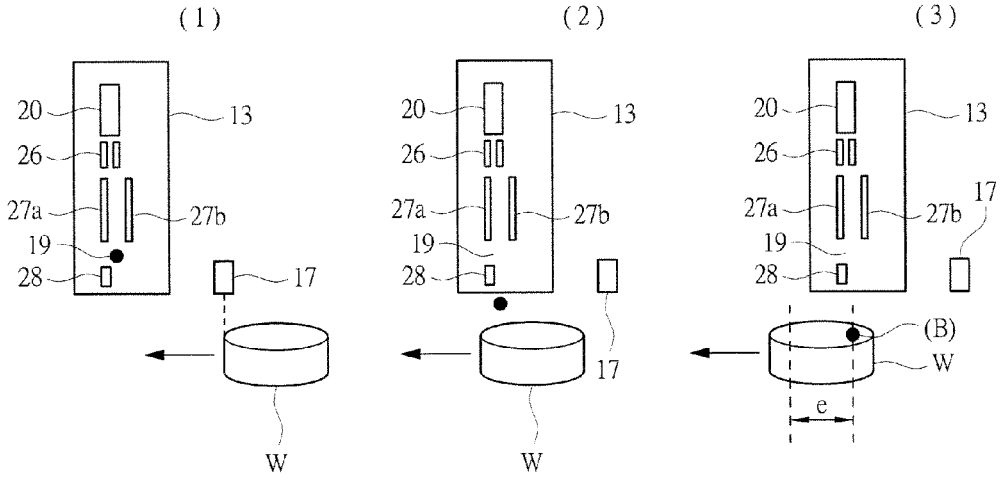
FIG. 8B illustrates outline drawings illustrating a landing state of an ink particle in an ink-jet recording apparatus serving as a comparative example.

FIG. 8A illustrates outline drawings illustrating a landing state of the ink particle with respect to the printing workpiece W in the ink-jet recording apparatus 10 of the present invention; and FIG. 8B illustrates outline drawings illustrating a landing state of the ink particle in the ink-jet recording apparatus as a comparative example.

As illustrated in FIG. 8A, when the electrification timing for transmitting the electrification signal to the electrification electrode 26 is advanced by the ink flying time Ti after the print sensor 17 detects the printing workpiece W, the ink particle lands on an ideal position (A) with respect to the moving printing workpiece W as illustrated in (1) to (3). On the other hand, when the electrification timing is set at the write-starting time To, an actual printing position (B) is displaced by a distance "e" from the ideal position (A) as illustrated in FIG. 8B.

Since the faster the moving speed of the printing workpiece W, the larger the displacement of the printing position, in the case in which control is carried out so that the electrification signal is transmitted to the electrification electrode 26 at the point when the write-starting time To is elapsed after the print sensor 17 detects the printing workpiece W as illustrated in FIG. 7, the case in which the printing workpiece W is moved at a low speed is assumed to be FIG. 8A, and the case in which the printing workpiece W is moved at a high speed faster than that of FIG. 8A is assumed to be FIG. 8B; in this case, the actual printing position is displaced from the ideal printing position. In this manner, when the conveyance moving speed of the printing workpiece W is increased, the displacement of the printing position is increased; however, even when the printing workpiece W is conveyed and moved at high speed, printing can be carried out at the ideal position by advancing the electrification timing to the point before the write-starting time To as illustrated in FIG. 6.

The ink flying time Ti is different depending on the printing distance La illustrated in FIG. 5. If all of the printing workpieces W conveyed by the belt conveyer 15 have the same size, the printing distance La is the same distance with respect to all of the printing workpieces W. On the other hand, if a plurality of types of printing workpieces W having different sizes are mixed and conveyed at the same time by the belt conveyer 15, the printing distance La is different depending on the printing workpiece W.

Methods for calculating the printing distance La include: a distance inputting method in which the flying time of the ink particles at the printing distance La is obtained based on the printing distance La input when the operator operates the touch panel 35 and a distance measuring method in which the printing distance La is detected by a printing distance measuring device to calculate the flying time of the ink particles. The distance inputting method is suitable for the case in which all of the printing workpieces conveyed by the belt conveyer 15 have the same size in the above-described manner. On the other hand, the distance measuring method is suitable for the case in which the plurality of types of printing workpieces W having different sizes are mixed and conveyed.

Figure 9:
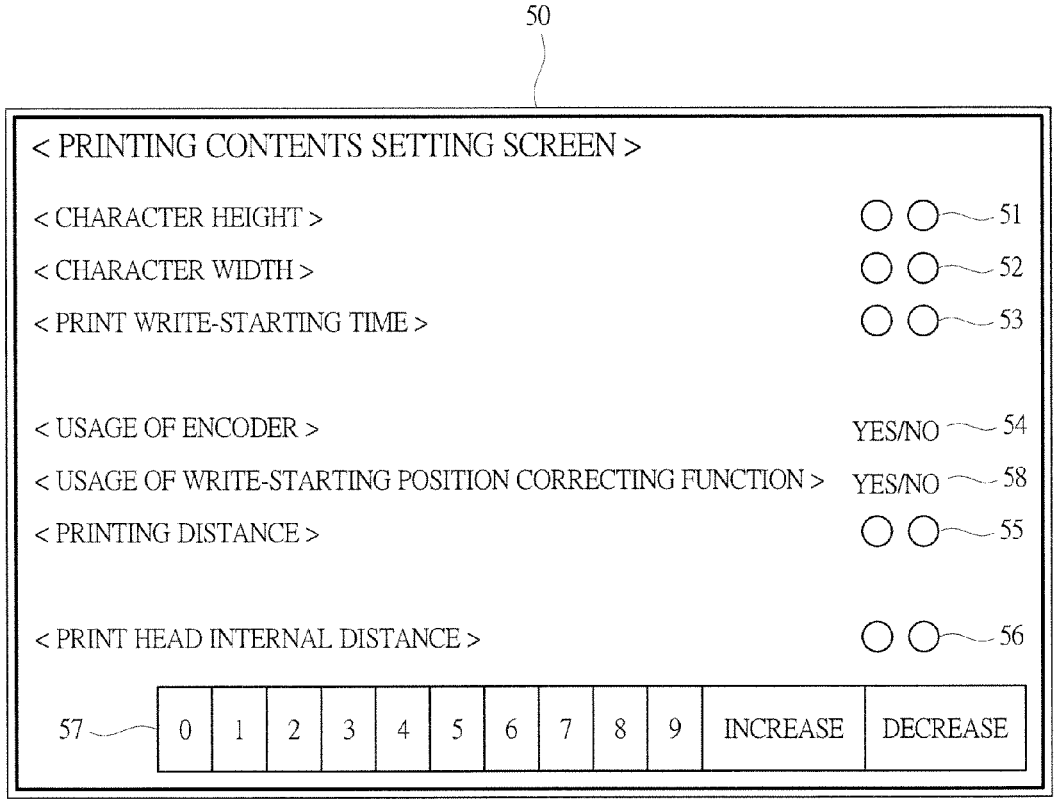
FIG. 9 is a front view illustrating a printing-contents setting screen of a touch panel.

FIG. 9 is a front view illustrating a printing contents setting screen 50 of the touch panel 35 of the ink-jet recording apparatus 10 of the distance inputting method. The screen 50 is provided with a character height input part 51, a character width input part 52, a write-starting time input part 53 for inputting the write-starting time To, and an encoder marking part 54 for inputting whether the encoder 16 is to be used or not; and, in addition to that, the screen is provided with a printing distance input part 55 serving as an input operation part for inputting the information of the printing distance La and a head internal distance input part 56 for inputting the value of the head internal distance Lb. The numerical values for these input parts are input by operating a numerical value input part 57, and the input values are stored in the RAM 32.

The ink-jet recording apparatus 10 is capable of correcting the electrification timing so as to advance the electrification timing to the point before the write-starting time To by the ink flying time Ti as illustrated in FIG. 6 and is also capable of setting the electrification timing at the point when the write-starting time To is finished as illustrated in FIG. 7. The printing contents setting screen 50 illustrated in FIG. 9 is provided with a mode switching input part 58 in order to carry out switching between the mode in which the electrification timing is corrected and the mode in which the electrification timing is not corrected. In FIG. 9, input numerical values are displayed by lighting respectively in the parts illustrated by circles.

Figure 10:
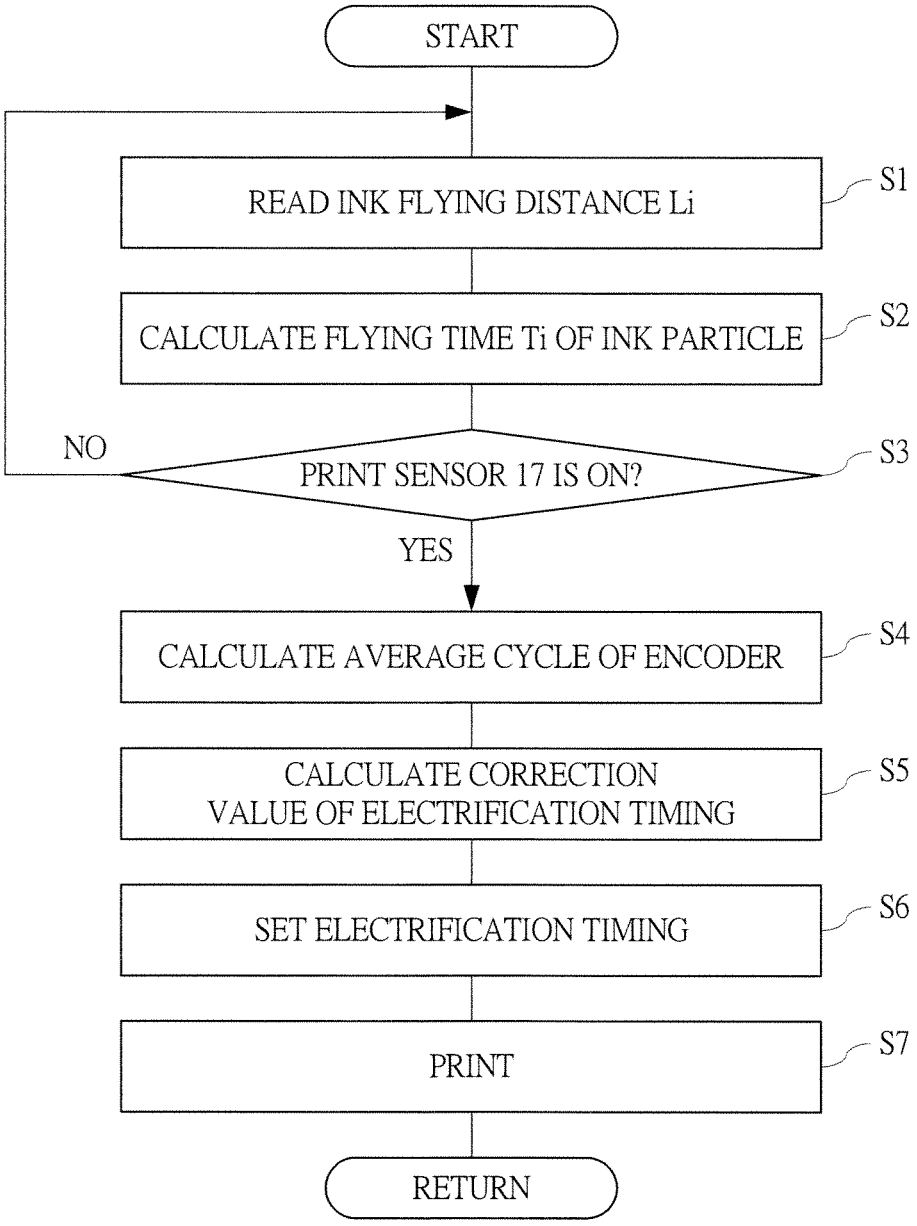
FIG. 10 is a flow chart illustrating an example of a control algorithm of printing timing in the ink-jet recording apparatus of the present invention.

FIG. 10 is a flow chart illustrating another example of a control algorithm of the printing timing of the ink-jet recording apparatus, wherein the distance inputting method is used.

The information of the printing distance La is input in advance when the operator operates the printing distance input part 55, the head internal distance Lb is input in advance by operating the head internal distance input part 56, and the input information is stored in the RAM 32 serving as a storage means.

When printing operation with respect to the printing workpiece W is started, the ink particle flying distance Li, which is the sum of the printing distance La and the head internal distance Lb, is read from the RAM 32 in step S1; and the ink flying time Ti is calculated by the MPU 31 serving as a flying time calculating means in step S2. In this state, when the print sensor 17 is detected to be on in step S3, the average cycle of the encoder 16 is calculated, and a correction value of the electrification timing is calculated by the MPU 31 serving as an electrification timing control means (steps S4, S5). The calculation of the average cycle is calculated by the average value of the cycles corresponding to several tens of pulses as illustrated by a symbol P in FIG. 6. The correction value of the electrification timing is obtained by subtracting the ink flying time Ti from the write-starting time To. Based on the obtained correction value, the electrification timing of the electrification signal supplied to the electrification electrode 26 after the print sensor 17 is turned on is set, and printing is carried out in step S7; as a result, the printing is carried out at an ideal printing position.

The method for calculating the correction value include: a method in which the ink flying time is calculated based only on the printing distance La and a method in which the ink flying time is calculated based on the sum of the printing distance La and the head internal distance Lb like the above-described case. Even when the ink flying time is calculated based only on the printing distance La, the printing position can be set to a position close to ideal. However, when the ink flying time is calculated based on the sum, the printing position can be set to a position that is closer to ideal, and printing quality can be further enhanced.

In a production line in which the ink-jet recording apparatus 10 is used, the print head 13 is sometimes replaced by another print head 13 having a different head internal distance Lb. When the print head 13 is replaced by the other print head 13 having the different head internal distance Lb, the information of the new head internal distance Lb is input when the head internal distance input part 56 of the printing contents setting screen 50 illustrated in FIG. 9 is operated. When input of the information of the head internal distance Lb is enabled in this manner, the ink-jet recording apparatus 10 becomes capable of selectively using a plurality of types of print head 13 having mutually different head internal distances Lb.

Figure 11:
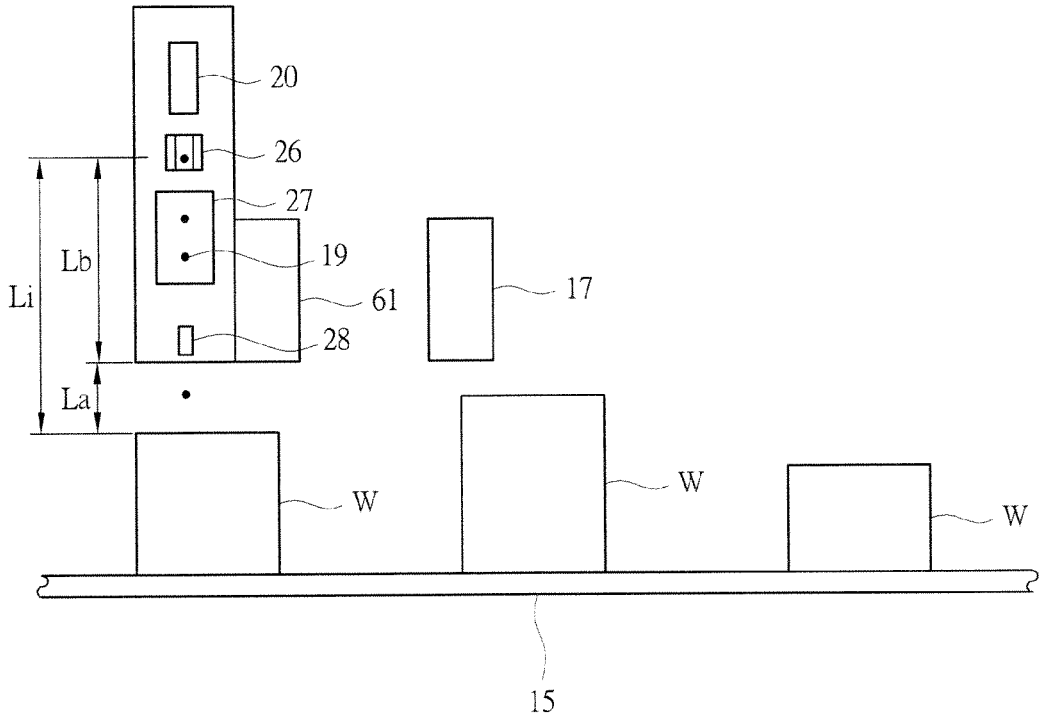
FIG. 11 is an outline drawing illustrating a print head in a state in which an ink particle is flying toward a printing workpiece in an ink-jet recording apparatus which is another embodiment of the present invention.

FIG. 11 is an outline drawing illustrating an ink-jet recording apparatus which is another embodiment of the present invention.

A plurality of printing workpieces W having mutually different sizes are mixed on and conveyed by the belt conveyer 15 illustrated in FIG. 11, and the printing distance La between the print head 13 and the printing workpiece W at the point when the printing workpiece W is moved to the position opposed to the print head 13 is different depending on the type of the printing workpiece W. The ink-jet recording apparatus 10 of the embodiment illustrated in FIG. 11 has a printing distance measuring device, i.e., a printing distance measuring sensor 61, which detects the printing distance La. A sensor having a light emitting element, which irradiates the printing workpiece W with light such as laser light, and a light receiving element, which receives reflected light, is used as the printing distance measuring sensor 61. The printing distance measuring sensor 61 is provided in the upstream side of the ink exhaust opening of the print head 13 in the moving direction of the printing workpiece W. In this ink-jet recording apparatus 10, the print sensor 17 is disposed in the upstream side of the printing distance measuring sensor 61. In the printing contents setting screen 50 of the ink-jet recording apparatus 10 of this type, the printing distance input part 55 for inputting the printing distance La becomes unnecessary.

Figure 12:
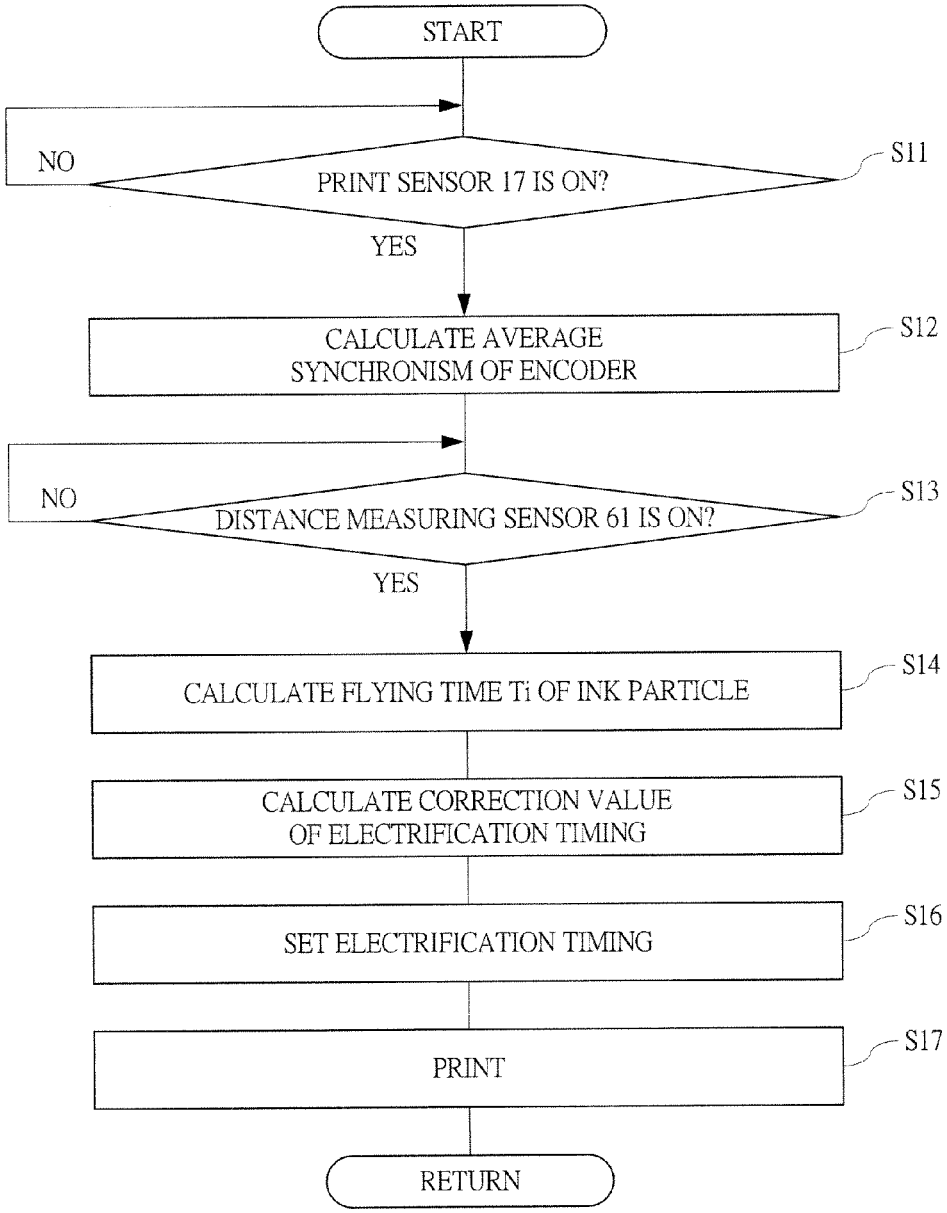
FIG. 12 is a flow chart illustrating another example of a control algorithm of printing timing of the ink-jet recording apparatus illustrated in FIG. 11.

FIG. 12 is a flow chart illustrating another example of the control algorithm of the printing timing of the ink-jet recording apparatus 10 illustrated in FIG. 11.

As illustrated in FIG. 12, printing operation with respect to the printing workpiece W is started; and, when the print sensor 17 is turned on in step S11, the average frequency of the encoder 16 is calculated (step S12). When the printing distance measuring sensor 61 is detected to be on in step S13, steps S14 to S17 are executed like steps S4 to S7 illustrated in FIG. 10. Like the above-described case, the method for calculating the correction value of the electrification timing in step S14 include: a method in which the ink flying time is calculated based only on the printing distance La and a method in which the ink flying time is calculated based on the sum of the printing distance La and the head internal distance Lb. In the printing contents setting screen 50 of the ink-jet recording apparatus 10 which is configured to calculate the ink flying time based only on the printing distance La, the head internal distance input part 56 becomes unnecessary.

In the ink-jet recording apparatus 10 illustrated in FIG. 11, while the printing distance measuring sensor 61 is disposed in the downstream side of the print sensor 17, the printing distance measuring sensor 61 may be disposed in the upstream side of the print sensor 17.

The present invention is not limited to the above-described embodiments, and various modifications can be made without deviating from the gist thereof. For example, in the case illustrated in FIG. 1, the ink-jet recording apparatus 10 is used for printing characters, etc. onto the printing workpieces conveyed by the belt conveyer; however, the ink-jet recording apparatus can be applied to the case in which the print head is moved with respect to the printing workpieces in a fixed state so as to print characters, etc. thereon. The ink-jet recording apparatus 10 may carry out printing on the lateral surface of the printing workpiece W as illustrated in FIG. 1 and FIG. 5 or may carry out printing on the upper surface of the printing workpiece W as illustrated in FIG. 11. Furthermore, printing can be carried out onto the bottom surface of the printing workpiece W; and, in that case, the printing is carried out onto the bottom surface of the printing workpiece via a slit provided in the conveyer 15.

INDUSTRIAL APPLICABILITY

This ink-jet recording apparatus 10 is used in the case in which the relative positions between the print head and the printing workpiece is detected by the encoder, and a character, figure, or the like is marked onto the printing workpiece by causing the ink particles to fly thereto.

The invention claimed is:

1. An ink jet recording apparatus having a print head incorporating a nozzle vibrating ink at a constant cycle, jetting out the ink, and atomizing the ink, an electrification electrode electrifying ink particles, and deflection electrodes deflecting the ink particles being electrified in a main scanning direction, the ink jet recording apparatus carrying out printing by causing the ink particle to fly to a printing workpiece relatively moving with respect to the print head in a sub scanning direction substantially orthogonal to the main scanning direction, the ink jet recording apparatus comprising:

a print sensor detecting that the printing workpiece is moved to a predetermined position in an upstream side of the relative movement direction with respect to the print head;

flying time calculating means for calculating flying time of the ink particle in a printing distance between the print head and the printing workpiece at the point when the printing workpiece is relatively moved to a position opposed to the print head; and electrification timing control means for controlling timing of an electrification signal supplied to the electrification electrode in accordance with the flying time and setting a printing position with respect to the printing workpiece, wherein the electrification timing setting means sets the printing position by subtracting the ink flying time from print write-starting time, which is from detection of the printing workpiece by the print sensor until printing.

2. The ink jet recording apparatus according to claim 1, comprising:

an input operation part for inputting information of the printing distance; and storage means for storing the input information of the printing distance, wherein the flying time calculating means calculates the flying time based on the information of the printing distance stored in the storage means.

3. The ink jet recording apparatus according to claim 1, comprising a printing distance measuring sensor detecting the printing distance, wherein the flying time calculating means calculates the flying time based on the information of the printing distance detected by the printing distance measuring sensor.

4. The ink jet recording apparatus according to claim 1, comprising an encoder outputting a pulse waveform proportional to a speed of the relative movement of the printing workpiece with respect to the print head, wherein electrification timing is controlled based on the number of pulses corresponding to the flying time.

5. The ink jet recording apparatus according to claim 1, wherein internal flying time of the ink particle in a print head internal distance between the electrification electrode and a distal end surface of the print head is added to the flying time to control electrification timing.

* * * * *